United States Patent [19]

Gragg et al.

[11] Patent Number: 4,806,032

[45] Date of Patent: Feb. 21, 1989

[54] CONICAL VENT CONTAINING CAPILLARY BORE

[75] Inventors: Brian D. Gragg; Jon J. Fong; Arthur K. Wilson, all of San Diego, Calif.

[73] Assignee: Hewlett-Packard Company, Palo Alto, Calif.

[21] Appl. No.: 48,190

[22] Filed: May 11, 1987

[51] Int. Cl.[4] ..... B41J 32/00; B65D 51/16

[52] U.S. Cl. ..... 400/194; 400/679; 400/719; 137/43; 164/234; 220/205; 220/85 VS; 222/189

[58] Field of Search ..... 400/124, 679, 719, 194; 220/85 VS, 202, 205; 137/43; 164/234, 338.1; 222/189

[56] References Cited

U.S. PATENT DOCUMENTS

| | | | |
|---|---|---|---|
| 2,456,337 | 12/1948 | Soper | 137/43 X |
| 2,720,666 | 11/1956 | Knight | 137/93 X |
| 2,807,064 | 9/1957 | Jay | 164/234 |
| 3,910,302 | 10/1975 | Sadlir | 137/43 |
| 4,195,682 | 4/1980 | Muller | 164/234 X |
| 4,399,009 | 6/1983 | Kanagai et al. | 400/679 |
| 4,632,174 | 12/1986 | Renel | 164/338.1 X |

FOREIGN PATENT DOCUMENTS

| | | | |
|---|---|---|---|
| 2546109 | 11/1984 | France | 400/719 |
| 100090 | 6/1982 | Japan | 400/719 |
| 124524 | 8/1983 | Japan | 400/719 |
| 147374 | 8/1985 | Japan | 400/124 |
| 320331 | 3/1972 | U.S.S.R. | 164/234 |
| 1136403 | 2/1966 | United Kingdom | 220/202 |
| 2125917 | 3/1984 | United Kingdom | 220/202 |

OTHER PUBLICATIONS

IBM Tech. Disc. Bulletin, "Tubeaxial Fan Airflow Deflector", vol. 28, No. 10, Mar. 1986, p. 4367.

*Primary Examiner*—Edgar S. Burr
*Assistant Examiner*—James R. McDaniel
*Attorney, Agent, or Firm*—William J. Bethurum

[57] ABSTRACT

A conical vent (14) for a cartridge (10) is located on an inner surface (20) of the cartridge. The conical vent includes a conical-shaped member (26) having a base (28) and an apex (30). An opening (32) extends through the center of the conical-shaped member (26) to provide an air passage for a cartridge (10). The opening (32) is adapted to create a capillary force on a small amount of liquid (59) that might enter the opening to prevent any remaining liquid from leaking through the opening. The vent also includes a groove or capillary trap (34) that encircles the base of the conical-shaped member. Also, a pair of upright walls (36) and (38) surround the conical-shaped member and cooperate with the capillary trap to divert liquid to the base of the conical-shaped member and away from its apex. A second conical-shaped member (52) integral with an outer surface (22) of the cartridge can be positioned directly opposite the first-mentioned conical-shaped member to help create and maintain the capillary force created in the opening (32). Another capillary trap (56), extending around the second conical-shaped member, traps any liquid that might escape through the opening.

19 Claims, 3 Drawing Sheets

Fig. 2.
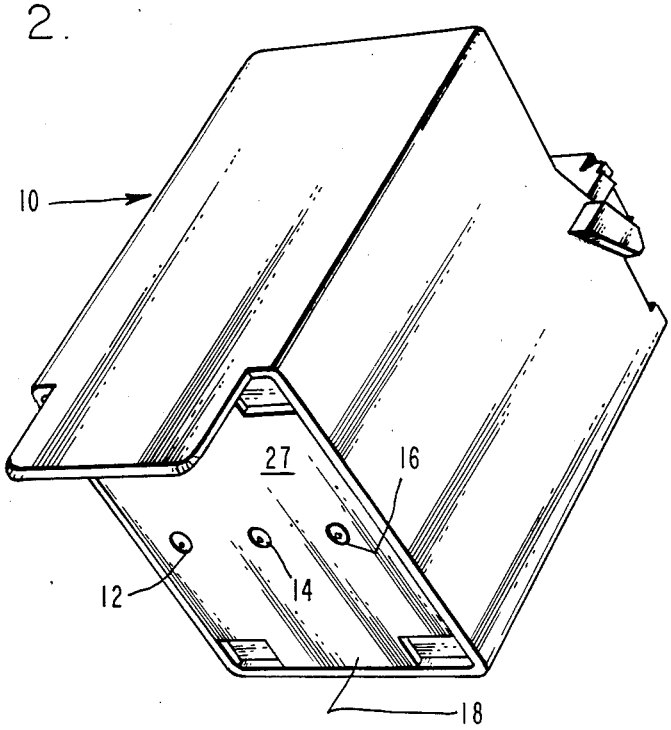
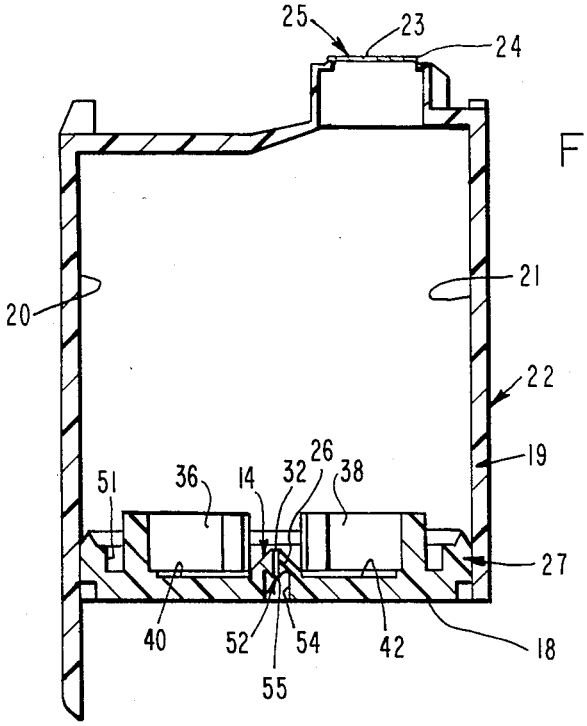
Fig. 4.

CONICAL VENT CONTAINING CAPILLARY BORE

TECHNICAL FIELD

The present invention relates generally to vents for enclosed receptacles, and, more particularly, to a conical vent having an opening that allows air to enter a liquid-retaining cartridge yet prevents liquid from escaping through the same opening.

BACKGROUND ART

The advancement of high speed printing equipment, such as dot matrix and ink jet printers, has tremendously increased the speed in which a letter perfect document can be created. Due to the speed at which ink is applied to a document, a fresh and continuous reservoir of ink is required. Ink is usually supplied in disposable ink cartridges that are designed for easy installation on the printing equipment. Once a cartridge is empty, it can be easily removed and replaced with a new one.

Most prior art ink cartridges utilize negative pressure to draw the ink from the cartridge. The reservoir of ink is usually absorbed by a foam-like material that fills the cavity of the cartridge. Ink is expelled from the cartridge by using a partial vacuum that draws or sucks the ink from the foam-like material through an opening or nozzle located on the cartridge. A vent is required since air has to enter the cartridge to displace the ink as it is being drawn out. If an air opening is not present, the ink or other liquid cannot be properly drawn out of the cartridge.

One of the problems typically associated with ink cartridges, especially larger cartridges used in ink jet printers, is ink leaking through the air opening. Ink can possibly escape through the air opening if the cartridge is jostled or positioned such that some ink may accumulate in the air opening. Ink then can leak out along the outer wall of the cartridge or can splash onto surrounding areas. Ink can also be transferred to the hands or clothing of a person replacing or touching the cartridge. Certain types of ink can sometimes be very difficult to remove and can sometimes permanently stain articles of clothing.

This leakage problem has been of special concern during the shipment of the cartridges. During shipping, the cartridge can be inadvertently turned over so that the air vent is directly below the ink-filled cavity. Due to gravitational forces, some ink may trickle down from the absorbent foam material and can accumulate over the air vent. In this position, it is possible for an appreciable amount of ink to escape through the air vent. Also, the cartridge could possibly be agitated or jostled during shipment which could also cause some loss of ink through the air vent.

Some prior art ink cartridges avoid this leakage problem by using filter materials to prevent ink from leaking through the air vent. These filter materials, however, are often quite delicate and can be damaged during shipment. An ink cartridge having a defective filter may allow ink to leak to its outer surface and may have to be discarded because of this leakage. Or, a defective filter may cause leaking ink to block the vent so that the cartridge no longer works. Also, these filters can increase the cost of each ink cartridge.

Leakage can also occur if the ink cartridge is transported by airplane. Generally, the pressure inside the ink cartridge is slightly lower than the pressure outside the cartridge. When the cartridge is brought to a high altitude by an airplane, for example, the pressure outside the cartridge can become less than the pressure inside the cartridge. If this occurs and if the pressure differential is substantial, ink within the cartridge can be forced through the air vent where it again can cause a mess. Even if the cartridge can be cleaned for usage, there is a needless loss of ink and a possibility that the person cleaning the cartridge may become stained with ink.

While prior art ink cartridges are somewhat reliable, they have the above-mentioned shortcomings that diminish their usefulness. Therefore, there is a need to create an inexpensive, yet reliable, air vent for an ink cartridge that helps retain the ink within the cartridge, but yet allows an air passage for venting purposes.

DISCLOSURE OF INVENTION

The present invention has as its objective the elimination of the above-mentioned and additional disadvantages associated with conventional vents used on liquid-retaining containers, such as ink cartridges. In its most general form, the present invention is a conical vent that is placed on the inner or retaining surface of housing that forms the container or cartridge. The vent is a conical-shaped member having a tip or apex and a base. The conical-shaped member has an air opening that extends from the inner surface to the outer surface of the housing. The air opening extends through the center of the conical-shaped member and is adapted to create a capillary force on a small amount of liquid that may enter it. The capillary force exerted on the trapped liquid is usually sufficiently strong to prevent more liquid from flowing through the opening. In general terms, the small amount of trapped liquid acts somewhat like a "plug" to prevent remaining liquid from escaping through the air opening.

The present invention also includes means for diverting liquid away from the conical-shaped member. These diverting means may take the form of a circular, capillary trap or groove that extends around the base of the conical-shaped member. Additional grooves or capillary traps are connected to the circular capillary traps and extend away to draw liquid away from the conical-shaped member. There are also upright walls located near the base of the conical-shaped member which, in conjunction with the capillary traps, act to draw liquid to the base and away from the apex of the conical-shaped member. These walls are also designed to create capillary forces that help keep residual liquid away from the apex of the conical-shaped member. This specific structure helps to keep the air opening clear, thus allowing air to be drawn into the cartridge as liquid is drawn out.

The present invention provides a novel air vent that provides a passage for air to enter the cartridge and prevents liquid from escaping through the air passage. If a cartridge using the present invention should be accidentally turned over, no appreciable liquid should escape through the air opening. Also, if the cartridge is jostled, no liquid should escape. Once a small amount of liquid has entered the air opening, only a slight pressure differential is needed to clear the liquid through the opening so that air can once again enter the cartridge.

The present invention eliminates the need for extra parts such as filter materials that help prevent the liquid or ink from escaping through the air opening. The conical vent can be easily molded directly into the housing of the cartridge or container which results in an inexpensive and more reliable venting system than those used in other prior art cartridges. The invention also eliminates the leakage problem typically associated in shipping the cartridges, since leakage has virtually been eliminated.

BRIEF DESCRIPTION OF THE DRAWINGS

A complete understanding of the present invention and other advantages and features thereof may be gained from a consideration of the following preferred embodiments taken in conjunction with the accompanying drawings in which:

FIG. 2 is a perspective view of the same cartridge depicted in FIG. 1 showing a preferred form of the conical vent.

FIG. 4 is a cross-sectional side view of one of the compartments that make up the cartridge.

BEST MODES FOR CARRYING OUT THE INVENTION

Figure 1:
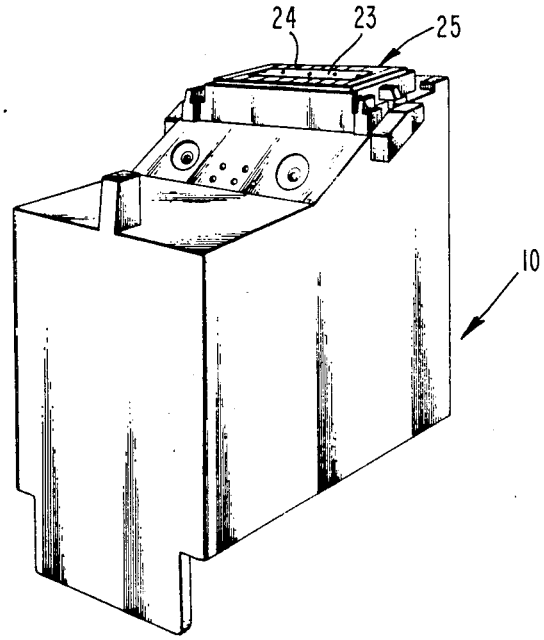
FIG. 1 is a perspective view of a cartridge built in accordance with the present invention.

While the present invention is susceptible of various modifications and alternative constructions, the embodiment shown in the drawings will herein be described in detail. It should be understood, however, that it is not the intention to limit the invention to the particular form disclosed; but, on the contrary, the intention is to cover all modifications, equivalences and alternative constructions falling with the spirit and scope of the invention as expressed in the appended claims.

Referring now to the drawings wherein like numerals of reference designate like elements throughout, a container or cartridge 10 built in accordance with the present invention is shown in FIGS. 1 and 2. As is shown best in FIG. 2, the cartridge 10 includes three air vents 12, 14 and 16 that extend along a wall 18 of the cartridge 10. These vents are built in accordance with the present invention and are structurally identical to each other.

Three vents are formed on the side wall 18 since the cartridge 10 can be divided into three separate compartments for storing liquids such as ink. A vent is included for each compartment formed in the cartridge 10. The cartridge itself can be a single compartment with a single air vent; however, it is possible to divide the cartridge into any number of individual compartments.

A cross-sectional side view of one of the compartments of the cartridge 10 is shown in FIG. 4. The cartridge 10 includes a housing 19 having an inner surface 20 and outer surface 22. The inner surface 20 creates a cavity 21 that retains an absorbant, foam-like material (not shown). This foam-like material absorbs the liquid and retains it in the cartridge until it is ready to be drawn out through an outlet opening or nozzle 23 (shown in FIGS. 1 and 4) that extends through a front plate 24 on the cartridge 10 and comprises a portion of a printhead mechanism 25.

Figure 3:
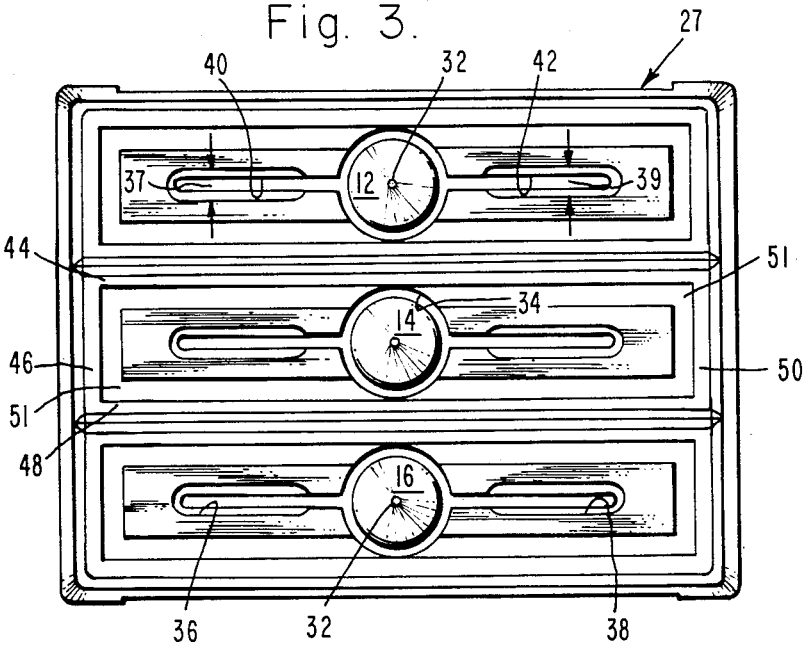
FIG. 3 is a top plan view of the conical vent showing the capillary traps and upright walls that help draw liquid away from the conical vent.

The conical vent 14 is also shown in FIG. 4 and as it appears on a molded piece 27 shown in FIG. 3. FIG. 3 shows the three conical vents that are formed on the molded piece 25. This piece 27 also forms the wall 18 of the cartridge depicted in FIGS. 1 and 2. For purposes of discussion, only one conical vent will be described in detail since the other vents are structurally identical.

Figure 5:
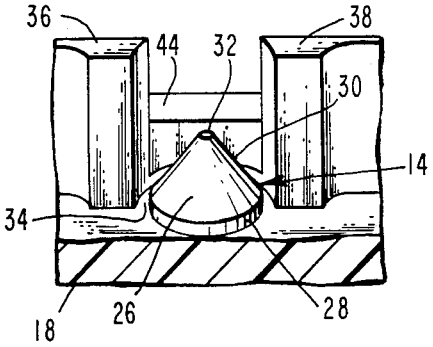
FIG. 5 is a perspective view, partially in cross-section, showing the conical vent, the capillary traps and the upright walls.

The conical vent 14 includes a conical-shaped member 26 that is integral with the inner surface 20 of the housing 18 (see FIG. 4). The conical-shaped member 26 includes a base 28 and an a tip or apex 30. The base 28 is integral with the inner surface 20 and the apex 30 extends away from this same surface. Actually, the apex 32 does not converge to a point as found in a true cone. Rather, the end of the conical-shaped member is truncated due to an opening that extends throught its center (see FIGS. 3 and 5). The end of the conical-shaped member is nevertheless herein referred to as the tip or apex 30.

The opening 32 extends from the inner surface 20 to the outer surface 22 to provide a passage that allows air to enter the cartridge as liquid is drawn out. This opening 32 extends through the center of the conical-shaped member 26 (see FIG. 3) and is adapted to provide a capillary force on a small amount of liquid that may enter it. The capillary force exerted on the small amount of liquid entering this opening 32 helps prevent additional liquid from flowing through the same opening.

The conical vent 14 also includes means for diverting liquid away from the conical-shaped member 26. Referring again to FIG. 3, these diverting means are shown as a groove or capillary trap 34 that extends around the base 28. This capillary trap 34 extends into the inner surface 20 of the housing to help channel liquid to the base 28, thus keeping fluid away from the apex 30 of the conical-shaped member 26.

Figure 6:
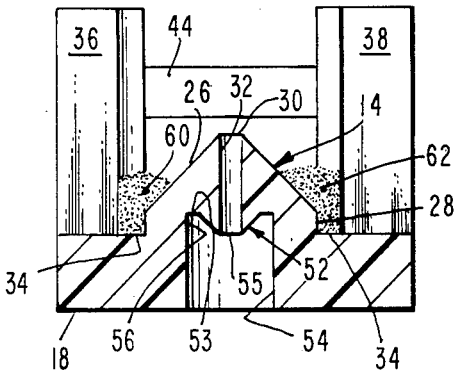
FIG. 6 is a cross-sectional side view of the conical vent.
Figure 7:
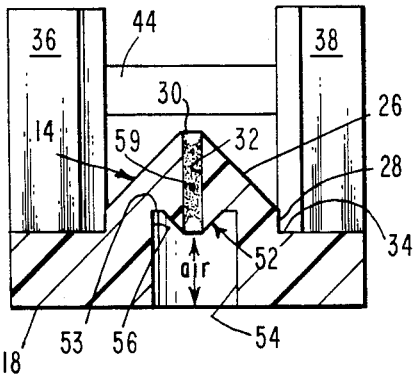
FIG. 7 is a cross-sectional view of the conical vent showing a small amount of liquid trapped within the air opening.

The conical-shaped member 26 is also surrounded by a pair of upright walls 36 and 38 which also cooperate with the circular, capillary trap 34 to draw liquid to the base 28, thus keeping the apex 30 free of liquid (see FIG. 6). The upright wall 36 has a U-shaped structure that forms a recess 37 which can create a capillary force on any residual liquid that may be in the vicinity of the conical-shaped member 26. Another capillary trap 40 connected to the circular, capillary trap 34 also directs liquid away from the conical-shaped member 26. Again, any liquid that may accumulate within this capillary trap 40 is held there due to the capillary force created by the trap and the U-shaped structure of the upright wall 36. Similarly, the second upright wall 38 has a U-shaped structure that also forms a recess 39 for channeling liquid away from the conical-shaped member. A second capillary trap 42 also extends from the circular, capillary trap 34 to also help divert liquid away from the conical-shaped member 26. Any liquid that accumulates in the capillary traps 34, 40 and 42 or between the upright walls 36 and 38 can eventually evaporate or can trickle harmlessly away from the conical vent.

The conical-shaped member 26 and upright walls 36 and 38 are surrounded by four outer walls 44, 46, 48 and 50. As with walls 36 and 38, walls 44 and 48 cooperate with the capillary trap 34 to draw liquid to the base 28. A small space 51 formed between these outer walls 44, 46, 48 and 50 and the upright walls 36 and 38 also helps to channel liquid away from the conical-shaped member 26. This space 51 is small enough to also create a capillary force on any residual liquid that might accumulate between the outer and upright walls. Again, liquid trapped in tis space 51 can be diverted away from the conical vent and can eventually evaporate.

The conical vent 14 can also include a second or outer conical-shaped member 52 that helps create the capillary force on any liquid that might enter the air opening 32. (See FIGS. 4 and 6). This second conical-shaped member 52 is aligned with the other conical-shaped member 26 so that the opening 32 also extends through the center of the second conical-shaped member 52. The second conical-shaped member 52 also includes a base 53 and a tip or apex 55. The base 53 is generally integral with the outer surface 22 of the housing and the apex 55 extends away from the outer surface. The second conical-shaped member 52 is usually smaller than the other conical-shaped member 26.

Figure 8:
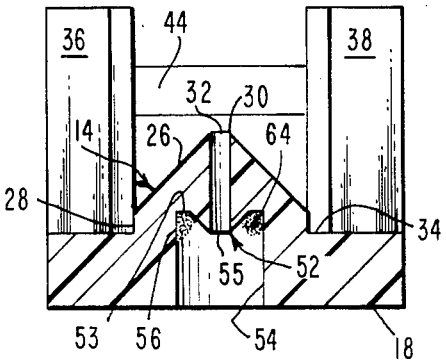
FIG. 8 is a cross-sectional side view of the conical vent showing ink or liquid that has accumulated in the outer capillary trap.
Figure 10:
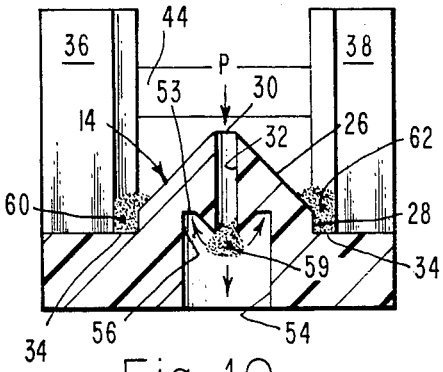
FIG. 10 is a cross-sectional side view of the conical vent showing how air pressure pushes trapped liquid out of the air opening and into the outer capillary trap.

This second conical-shaped member 52 can be set within a recess 54 formed in the outer surface of the housing. This recess 54 helps prevent small drops of liquid from reaching the outer surface of the housing. Another groove or outer capillary trap 56 surrounds the base 53 f the second conical-shaped member 52 to trap small amounts of liquid that may be blown out through the air opening during usage. (See FIGS. 8 and 10).

In operation, the opening 32 is usually in a horizontal position to provide a passage for air to enter into a cartridge as liquid is drawn out through the outlet opening. A reservoir of liquid or ink (not shown) absorbed in the absorbent, foam-like material can be drawn out of an opening or nozzle that forms part of the printhead mechanism. As the liquid is drawn out, air is drawn into the cavity of the cartridge through the opening 32.

During shipping, the cartridge can possibly be accidentally turned over so that some liquid within the cartridge may come near the conical vent. This position is depicted in FIG. 1, and FIGS. 6 through 10. When this occurs, it is possible for a small amount of liquid 59 to enter into the air opening 32. (See FIG. 7). This small amount of liquid 59 is usually trapped within the opening 32 and remains there due to the capillary force created by the opening 32. Generally, this force is strong enough to hold any additional, accumulated liquid within the cartridge, thus preventing additional leakage of liquid through the opening 32. This small amount of liquid 59 acts somewhat like a "plug" to prevent the remaining liquid from leaking through the air opening 32.

Figure 9:
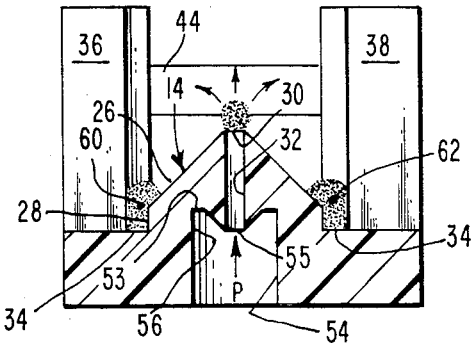
FIG. 9 is a cross-sectional side view of the conical vent showing how air pressure pushes trapped liquid through the air opening and back into the liquid reservoir.

When the cartridge is in use, the capillary traps and the conical-shaped member will keep the air opening clear of liquid as long as the liquid level is not large to cover the entire opening. FIG. 6 shows how the upright walls 36 and 38 create a capillary force that helps keep small amounts of liquid 60 and 62 away from the air opening 32. If the vent is turned to its horizontal position, the liquid 60 and 62 accumulating around the conical-shaped member will travel around the base via the circular capillary trap 34, thus preventing liquid from running across the opening. If a small amount of liquid should enter the air opening, a pressure differential can easily blow the trapped liquid 59 back through the opening 32, thus clearing the opening 32 of any liquid. FIG. 9 shows how air pressure can clear the liquid through the opening 32 to permit air to once again enter the cartridge. Generally, the trapped liquid in the opening is blown back into the cavity of the container. Since only a slight pressure differential is needed to clear the opening, any trapped liquid is usually blown through the opening when liquid is drawn through the outlet opening or nozzle.

It is also possible to blow any trapped liquid out of the opening towards the outer surface of the cartridge. This usually occurs when the pressure differential is directed out of the opening. (See FIG. 10). If a small amount of liquid 59 is blown through the air opening 32, the liquid can accumulate in the capillary trap 56 encircling the second conical-shaped member 52. Any accumulated liquid can easily evaporate in this capillary trap. Since the second conical member is placed within a recess 54 formed in the outer surface of the cartridge, any liquid blown out of the opening 32 should stay within the recess and away from the outer surface of the cartridge. Thus, even if a small amount of liquid escapes through the air opening, it is usually caught and retained at a location away from the user's hand or clothing. The liquid, such as ink, will eventually dry leaving only a small residue of solids that were suspended in the liquid.

The size of the opening is small enough so that evaporation of the liquid in the reservoir is very small. The cross-section of the air opening is usually circular, although any shape that also creates a capillary force may also be used. The diameter of the air opening can be approximately 0.4 millimeters and its length can be approximately 2.5 millimeters. This length and diameter create the necessary capillary force on a small amount of liquid that might enter the opening. However, any similar length-to-diameter ratio that creates a sufficient capillary force can be also be used.

The conical vent can be easily molded into one of the walls of the container or cartridge using injection molding techniques well known in the art. Generally, the angle or slant of the conical-shaped member is 45°, although different angles may also be used. The surrounding capillary traps and upright walls can also be easily formed using similar techniques. For example, the conical vents, capillary traps and uprights walls can be molded on a separate piece that forms one of the walls of the cartridge. (See, for example, the molded piece 27 shown in FIG. 3). This molded piece can then be easily inserted into the main body of the cartridge. The present invention requires no extra parts such as delicate filter materials that can be damaged during shipping or from use. Since the conical vent, capillary traps and walls can be molded directly into the container or cartridge, a less expensive and more reliable vent is created.

INDUSTRIAL APPLICABILITY

The conical vent with its capillary traps and upright walls is expected to find use in ink cartridges used for high speed printing equipment, such as ink jet printers.

Thus, there has been illustrated and describe a unique and novel conical vent that fulfills all of the objects and advantages set forth above. It should be noted that many changes, modifications, variations and other uses and applications will become apparent to those skilled in the art after considering this disclosure and the accompanying drawings. Therefore, any and all such changes, modifications, variations and other uses and applications which do not depart from the spirit and scope of the invention are deemed to be covered by the invention which is limited only by the following claims.

What is claimed is:

1. In combination a cartridge for retaining an amount of liquid ink and a vent for said cartridge comprising:

said cartridge including a housing having an inner surface and an outer surface, said inner surface being adapted to retain the liquid;

an outlet opening; and and said vent including a conical-shaped member integral with said inner surface and having an air opening defined by a bore that extends substantially axially through the center of said conical-shaped member, said bore extending from said inner surface to said outer surface of the housing and having a diameter small enough to constitute a capillary so as to create a capillary force on any small amount of liquid ink that may enter into said air opening to thereby substantially prevent significant quantities of ink from leaking from within said housing.

2. A vent for an ink cartridge defined by a housing having an outer surface and an inner surface adapted to retain an amount of liquid ink comprising:

a conical-shaped member integral with the inner surface of the housing having an opening defined by a bore that extends substantially axially through the center of the conical-shaped member, said bore extending from the inner surface to the outer surface of the housing and having a diameter small enough to constitute a capillary to provide a capillary force to substantially prevent ink from leaking from within said housing for creating a capillary force on a small amount of liquid that enters said opening.

3. The vent as defined in claim 2 further including means for diverting liquid away from said conical-shaped member.

4. The vent as defined in claim 3 wherein the conical-shaped member has a base and an apex, said apex being extended away from said inner surface and wherein said disposing means comprise a groove extending into the inner surface of the housing that encircles said base of said conical-shaped member.

5. The vent as defined in claim 4 further including at least one wall spaced apart from said conical-shaped member to create a capillary force that helps draw liquid to said base of said conical-shaped member and away from said apex of said conical-shaped member.

6. The vent as defined in claim 5 wherein said bore is tubular shaped.

7. The vent as defined in claim 1 further including a second conical-shaped member integral with the outer surface of the housing and aligned with said first-mentioned conical-shaped member so that said bore extends through the center of said second conical-shaped member.

8. The vent as defined in claim 7 further including means for diverting liquid that passes through said bore away from said second conical-shaped member.

9. The vent is defined in claim 8 wherein said diverting means comprise a groove extending into the inner surface of the housing and encircles said second conical-shaped member.

10. The vent as defined in claim 7 wherein said second conical-shaped member is smaller than the first-mentioned conical-shaped member.

11. The vent as defined in claim 7 wherein the second conical-shaped member has a base and an apex, said apex being extended away from the outer surface.

12. The vent as defined in claim 11 wherein said bore opening has a circular cross-section.

13. The combination as defined in claim 1 further including means for diverting liquid away from said conical-shaped member.

14. The combination as defined in claim 14 where further in said conical-shaped member has a base and an apex, said apex being extended away from said inner surface and wherein said disposing means comprise a groove extending into said inner surface and encircling said base of said conical-shaped member.

15. The combination as defined in claim 14 including at least one upright wall spaced apart from said conical shaped member to create a capillary force that draws liquid to said base of said conical member and away from said apex.

16. The combination as defined n claim 15 wherein said bore has a circular cross-section.

17. The combination as defined in claim 16 further including a second conical-shaped member integral with the outer surface of the housing and aligned with said first mentioned conical-shaped members so that said bore extends through the center of said second conical-shaped member.

18. The combination as defined in claim 17 further including means for diverting liquid away from said second conical shaped member.

19. The combination as defined in claim 18 wherein said second conical-shaped member is smaller than the first mentioned conical-shaped member.

* * * * *